US005397251A

United States Patent [19]

Kaminski

[11] Patent Number: 5,397,251

[45] Date of Patent: Mar. 14, 1995

[54] ELECTRICAL CONNECTOR AND AN ELECTRICAL TERMINAL THEREFOR

[75] Inventor: Christopher Kaminski, Buckland Brewer, England

[73] Assignee: The Whitaker Corporation, Wilmington, Del.

[21] Appl. No.: 150,671

[22] Filed: Nov. 10, 1993

[51] Int. Cl.[6] ..... H01R 29/00

[52] U.S. Cl. ..... 439/620; 439/699; 439/398

[58] Field of Search ..... 439/620, 699, 395, 396, 439/397, 398, 399, 400; 362/226

[56] References Cited

U.S. PATENT DOCUMENTS 4,626,060 12/1986 Inayoshi ..... 439/620 X

FOREIGN PATENT DOCUMENTS 2002597A 2/1979 United Kingdom .
2169458A 7/1986 United Kingdom .

*Primary Examiner*—P. Austin Bradley
*Assistant Examiner*—Jeanne M. Elpel
*Attorney, Agent, or Firm*—Eric J. Groen; Adrion J. LaRue

[57] ABSTRACT

An electrical connector comprises as shown in FIGS. 23 to 25, an insulating housing defining a socket for an electrical lamp bulb and first and second cavities and for receiving a first terminal and a second terminal respectively. The first terminal has a contact spring in the socket, the second terminal having a contact spring in the socket. An electric lamp bulb can be inserted into the socket so that contacts of the bulb are resiliently engaged by the respective contact springs. Each terminal also has a slotted plate portion for connection to an insulated electrical lead. The top wall of the housing is formed with two spaced holes for receiving lead wires of a diode. The first terminal has, a spring socket aligned with each of the holes and. Between the spring sockets, the first terminal has a reduced cross section severable portion, which is accessible to be sheared by shearing tooling, by way of an opening in the top wall and an opening in the opposite wall of the housing. Where the diode is to be connected in circuit with the bulb the severable portion is sheared out by means of the tooling, and the lead wires of the diode are inserted through the holes and the spring sockets. Where the diode is not needed, the severable portion is left in situ.

14 Claims, 15 Drawing Sheets

ELECTRICAL CONNECTOR AND AN ELECTRICAL TERMINAL THEREFOR

BACKGROUND OF THE INVENTION

Field of the Invention

This invention relates to an electrical connector for electrically connecting electrical conductors with the optional interposition of an electrical circuit component therebetween, and to an electrical terminal for such a connector.

BRIEF DESCRIPTION OF THE PRIOR ART

Where an electric lamp bulb having a coiled filament is to be connected to a circuit for switching the bulb on and off, the circuit comprising a voltage sensitive element, for example a semi-conductor chip, provision must be made for blocking the back electromotive force that is generated when the bulb is switched off, so that the switching circuit is protected. The need for such protection may arise, for example, in a coin freed electronic machine provided with a signal or indicator lighting. In order to protect the switching circuit, a circuit component in the form of a diode can be interposed between the lamp bulb and a supply lead connecting it to the switching circuit. Under some circumstances, some other circuit component, for example a resistor, may need to be connected in circuit with the lamp bulb. There are however, other circumstances, in which no circuit component need be connected in circuit with the lamp bulb.

SUMMARY OF THE INVENTION

According to one aspect thereof, the invention consists in an electrical connector comprising an insulating housing defining a socket for an electric lamp bulb, and first and second cavities for receiving first and second terminals, respectively, in electrical isolation from each other, each terminal having a contact spring in the socket for engaging a respective contact of the bulb and a lead connecting portion which is accessible externally of the housing for connection to an electrical lead, an external wall of the housing being formed with first and second lead wire guiding holes therein, the first terminal being formed with first and second lead wire receiving spring sockets each aligned with a respective one of said first and second holes, for the retention therein of a lead wire inserted through said respective hole, the first terminal having, intermediate said spring sockets, a portion which is accessible externally of the housing and is severable to divide the second terminal into two electrically isolated parts.

Where there is no need to connect a circuit component in circuit with the lamp bulb, the connector is ready for use, when the bulb has been inserted into the socket and the lead connecting portions of the terminals have been connected to leads.

Where a circuit component, for example a diode, needs to be connected in circuit with the lamp bulb, the severable portion of the first terminal is severed by means of suitable tooling and lead wires of the circuit component are inserted through the respective first and second holes and through the spring sockets aligned therewith to be retained therein, so that the circuit component is electrically connected in circuit with the lamp bulb when it has been inserted into the socket and the leads connected to the lead connecting portions of the two terminals.

The connector is accordingly usable in two different modes.

The socket may be arranged to receive a baseless lamp bulb. To this end, the contact springs of the first and second terminals are arranged in the socket in superposed, but laterally spaced, relationship with each other, a raised support for the flat contact bearing end portion of the baseless lamp bulb being provided in the socket beside each contact spring. The raised supports and the contact springs are so positioned relative to one another that each contact spring urges the contact bearing end portion of the lamp bulb against the raised support beside the other contact spring when the bulb has been inserted into the sockets. No means need therefore be provided for releasably retaining the bulb in the socket. Lamp bulb guides projecting from the socket, may, however, be provided for lightly gripping the inserted lamp bulb.

The housing of the connector may be elongate, the lead wire guiding holes being spaced from each other and being aligned with each other, longitudinally of the housing, whereby the width of the housing is reduced. This feature enables a series of lamp bulbs to be provided in close proximity to one another, in a crowded environment, for example a complex electronic coin freed machine.

Conveniently, the terminal receiving cavities may be divided from one another by means of a central internal wall of the housing, an end of the wall acting as a stop surface for limiting the insertion of the bulb into the socket, the central wall also acting as a terminal guide and, to this end, being formed with lateral grooves each for receiving a lateral edge of one of the terminals.

For convenience in severing the severable portion of the first terminal, said external wall of the housing is preferably formed with a first tooling access opening in alignment with the severable portion of the first terminal, an opposite external wall of the housing being formed with a second tooling access opening opposite to the first tooling access opening. This arrangement allows shearing tools to be inserted from opposite walls of the housing to shear out the severable portion of the first terminal.

According to another aspect thereof the present invention consists in an electrical terminal for use in a connector according to the invention, the terminal comprising a flat elongate plate having a first end and a second end, a cantilever contact spring projecting from the first end and being reversely bent so as to overlie one side of the plate in spaced relationship thereto, the other end of the plate being slotted to receive an insulated electrical lead, electrically to connect the core of the lead to the terminal, the plate being formed with a first and second lead wire receiving spring socket spaced from each other longitudinally of the plate, between the first and second ends thereof, each spring socket comprising a plurality of spring fingers projecting from an edge of an opening in the plate from the side thereof which is overlaid by the contact spring and converging towards one another in a direction away from the plate, the plate being formed with a severable portion of reduced cross section between said spring sockets.

According to yet a further aspect thereof, the present invention consists in an electrical connector for use in connecting first and second electrical conductors, optionally with a circuit component interposed therebetween, the connector comprising an insulating housing defining a terminal receiving cavity opening into opposite ends of the housing, and first and second aligned, through, tooling access openings intermediate said ends of the housing and being provided in respective first and second opposite external walls thereof, a one piece electrical terminal secured in the cavity having a first conductor connecting portion exposed for connection to the first conductor through one end of the cavity, a second conductor connecting portion exposed through the other end of the cavity, for receiving the second conductor and a severable, reduced cross section portion aligned with both of said openings and being located therebetween, one of said first and second opposite walls having a component lead wire guiding through hole on each side of said reduced cross section severable portion, the terminal being formed with first and second lead wire receiving spring sockets each aligned with a respective one of the holes, for retention therein of a lead wire inserted through said respective hole, the reduced cross section portion of the terminal being severable by means of tooling inserted through said tooling access openings, to divide the terminal into two electrically isolated parts.

The first conductor, may, for example, be an electrical terminal connected to a first contact of an electrical lamp bulb, the second conductor being a supply lead for the lamp bulb for connection to the second conductor connecting portion, the other contact of the lamp bulb being grounded, for example. The first conductor connecting portion could, in this case, be, for example, a receptacle for an electrical tab, the second conductor connecting portion, being for example, slotted to receive the lead.

The housing of a connector according to the present invention may be provided with laterally projecting cheeks, latch arms and with flat external surfaces, for cooperation in non-rotatably securing the connector in a hold in a mounting panel.

DETAILED DESCRIPTION OF THE PREFERRED EMBODIMENT

Figure 1:
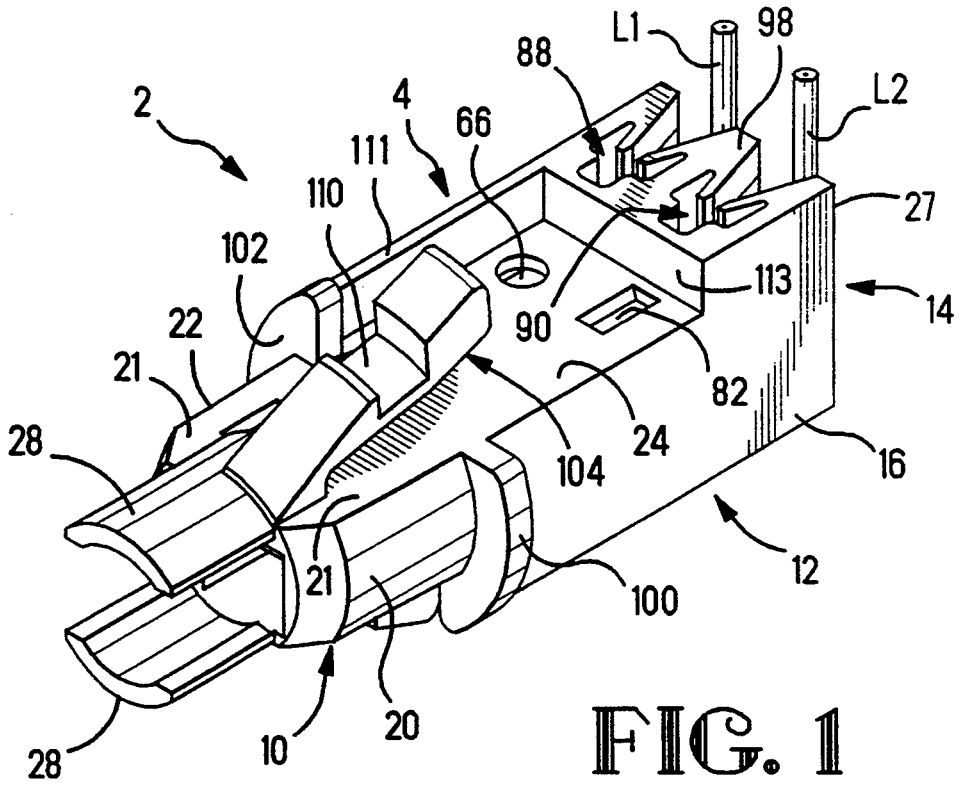
FIG. 1 is an isometric top view taken from the front of an electrical connector for electrically connecting contacts of a baseless electric lamp bulb to respective supply leads therefor, with the optional interposition of a diode between one of the leads and the respective contact of the bulb.

An electrical connector 2 for connecting insulated supply leads L1 and L2 (FIG. 1) to contacts C1 and C2 of a baseless electric lamp bulb (FIG. 25 and 27) having a coiled filament F, with the optional interposition of a diode D (FIG. 25) between the lead L1 and a respective one of the contacts of the bulb B; comprises a one piece moulded elongate insulating housing 4, a first electrical terminal 6 (best seen in FIGS. 15 to 18) and a second electrical terminal 8 (best seen in FIGS. 19 to 22). The connector 2 has a forward bulb socket 10, an intermediate diode receiving part 12 and a rear lead connecting part 14.

As best seen in FIGS. 1 to 4, the housing 4 comprises opposite side walls having planar portions 16 and 18, respectively, over the parts 12 and 14 of the connector 2, and oppositely outwardly bowed side wall portions 20 and 22, respectively, over the bulb socket 10. Each wall portion 20 and 22 has a flat top 21 and a flat bottom 23. The side wall portions 16 and 18, and 20 and 22, are bridged by a top wall 24 and a bottom wall 26. At its opposite end to the bulb socket 10, the housing 4 has a terminal receiving rear face 27.

Figure 10:
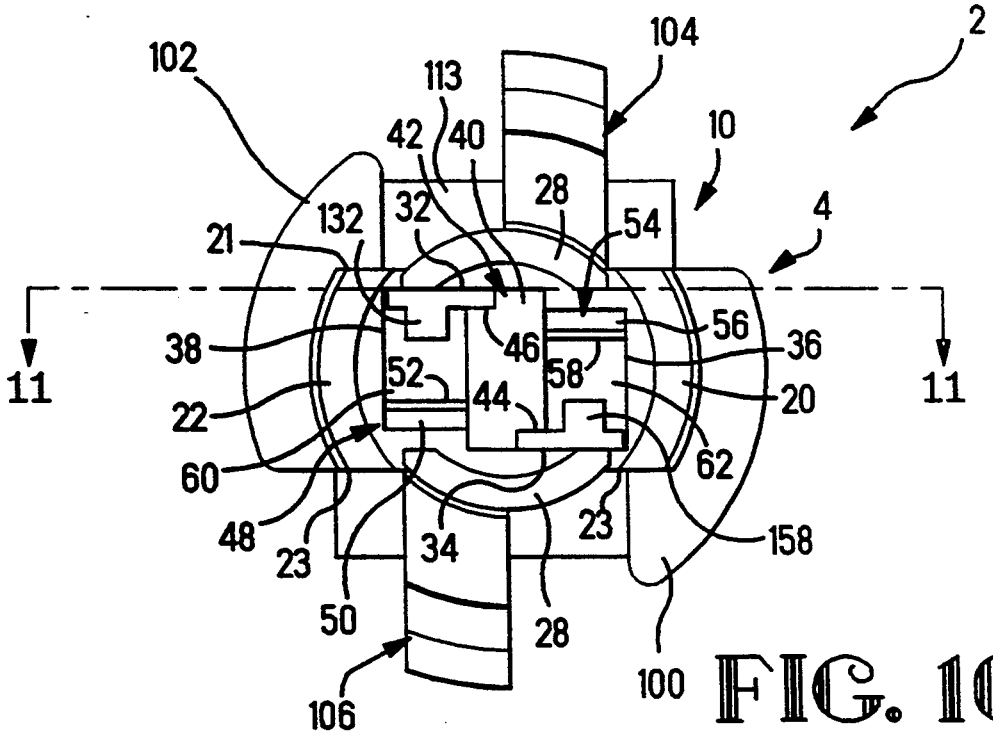
FIG. 10 is a front view of the connector.
Figure 25:
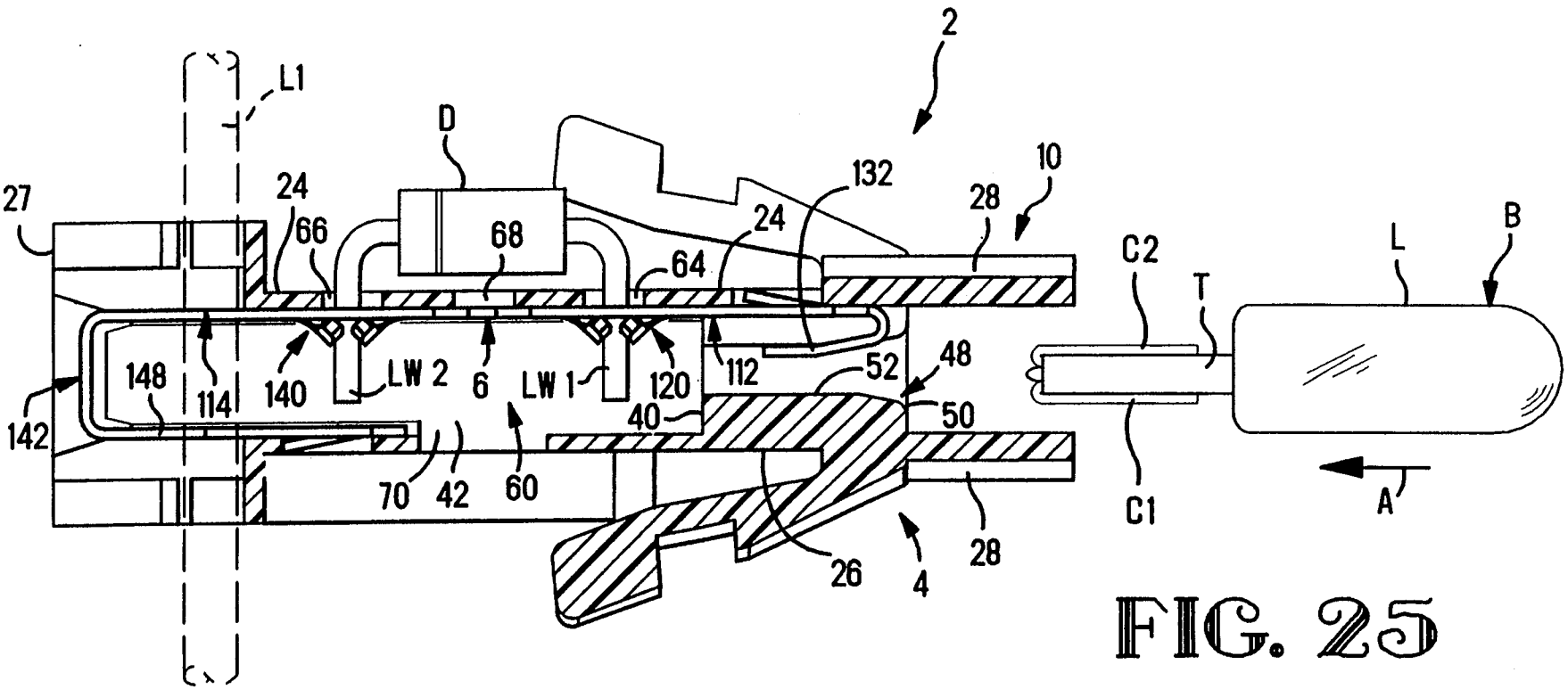
FIG. 25 is a similar view to that of FIG. 6 but showing the second terminal and the diode assembled to the housing and the lamp bulb about to be inserted into a lamp bulb socket of the housing.
Figure 26:
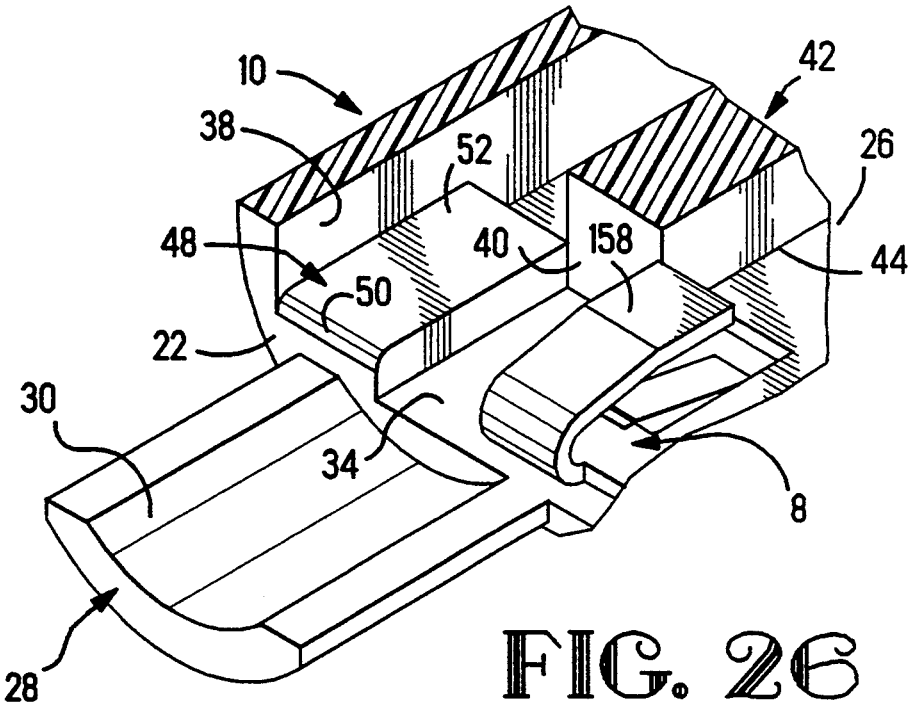
FIG. 26 is a diagrammatic fragmentary isometric view of the connector, taken from the front and illustrating details of the lamp bulb socket.
Figure 27:
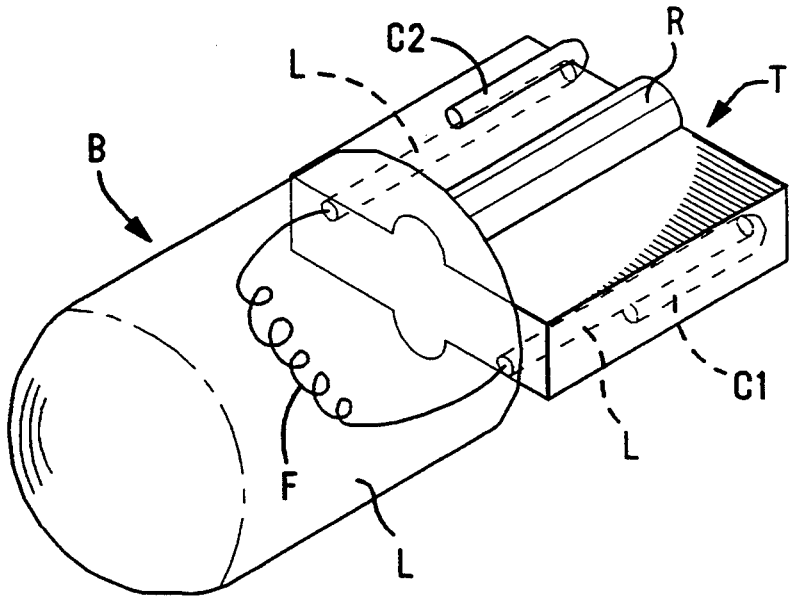
FIG. 27 is a diagrammatic isometric view of the baseless electric lamp bulb.

The bulb B comprises, as shown in FIGS. 25 and 27, a forward, generally cylindrical glass lamp envelope L from which projects rearwardly, a generally flat and rectangular, glass, contact supporting tail T. The tail T has a central longitudinal rib R, the bulb contacts C1 and C2 being disposed on opposite faces of the tail T and on opposite sides of the rib R. The contacts C1 and C2 are connected to the coiled filament F by respective leads L. There projects forwardly from the forward end of each wall 24 and 26 of the housing 4, an arcuate cross-sectional bulb guide 28, the guides 28 having opposed concave inner surfaces 30 for snugly receiving the lamp envelope L between them, so as to assist in guiding the tail T of the bulb B into the socket 10. As best seen in FIGS. 6, 8, 10 and 26, the interior of the socket 10 is defined by internal surfaces 32 and 34 of the forward end portions of the top and bottom walls 24 and 26, respectively, and by flat internal surfaces 36 and 38 of the side wall portions 20 and 22, respectively. The socket 10 is effectively terminated to the rear, by an end abutment surface 40 of a longitudinal, generally central internal wall 42 of the housing 4, which is formed integrally with the walls 24 and 26. On its side facing the wall surface 36, the wall 42 is formed with a longitudinal, lower terminal groove 44 adjoining the internal surface 34 of the lower wall 26. The wall 42 is also formed on its side facing the wall surface 38, with longitudinal upper terminal guide groove 46 adjoining the internal wall surface 32 of the upper housing wall 24. There projects from the wall surfaces 34 and 38, at the junction thereof, a lower support rib 48 for the bulb tail T, the rib 48 having a forwardly bowed, arcuate, bulb tail guiding surface 50 at the mouth of the bulb socket 10, and a flat, bulb tail abutment face 52 parallel with the wall surface 34, as best seen in FIG. 26. An upper support rib 54 for the bulb tail T, projects from the wall surfaces 32 and 36 at the junction thereof, as best seen in FIG. 10. The rib 54 has a bulb tail guiding forwardly bowed surface 56 and a flat, bulb tail abutment face 58 parallel with the surface 32.

Figure 5:
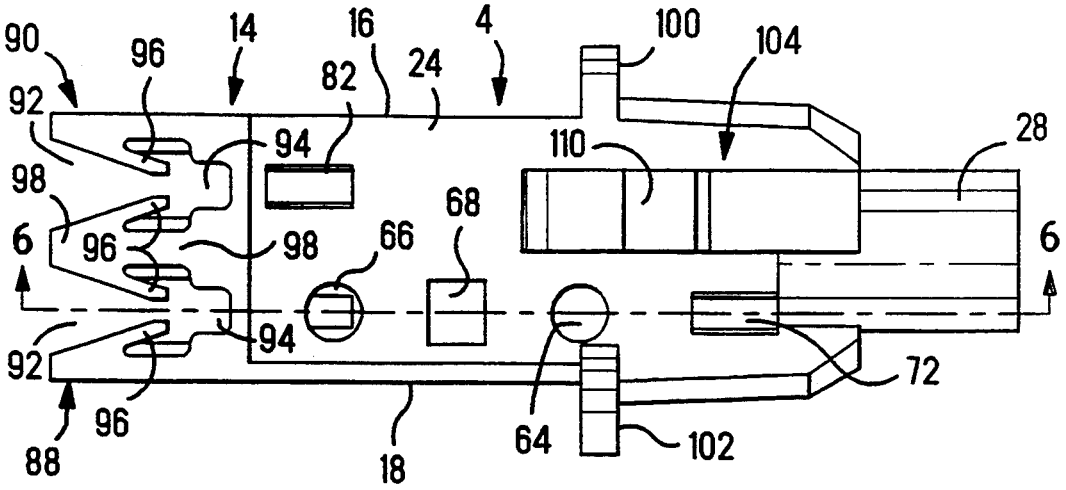
FIG. 5 is a top plan view of an insulating housing of the connector.
Figure 6:
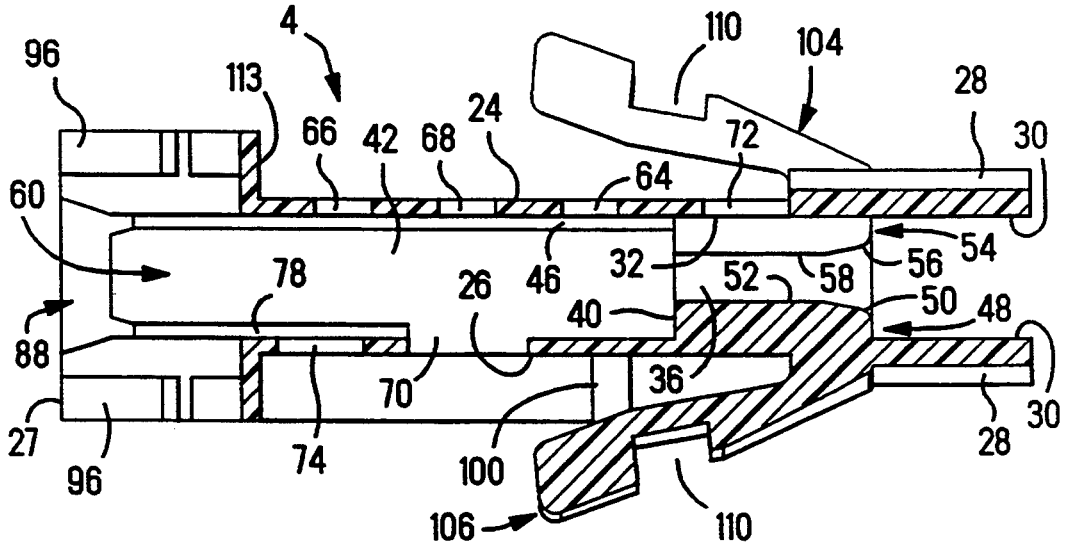
FIG. 6 is a view taken on the lines 6—6 of FIG. 5.
Figure 7:
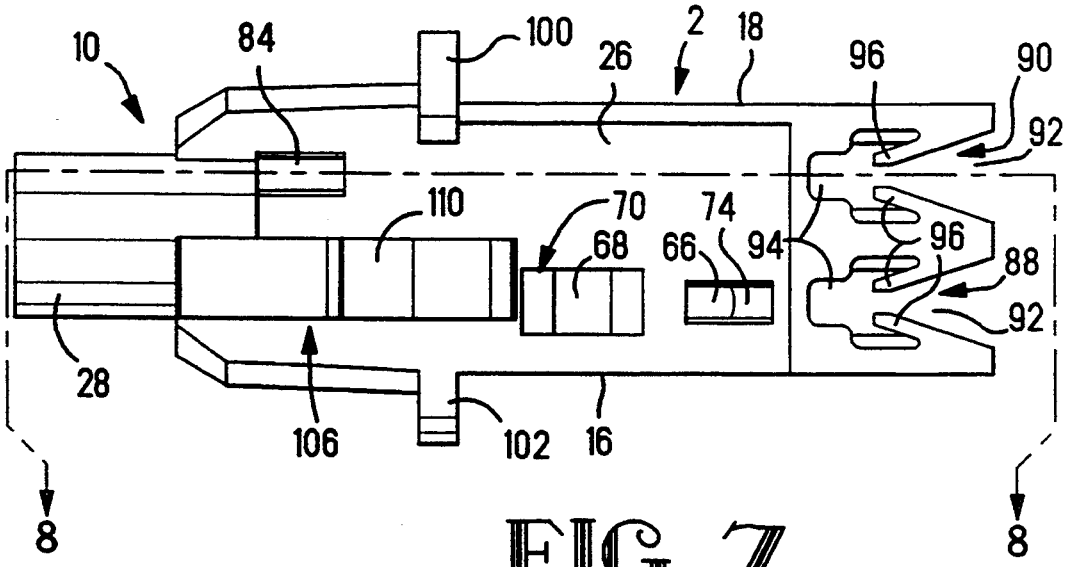
FIG. 7 is an underplan view of the housing.
Figure 8:
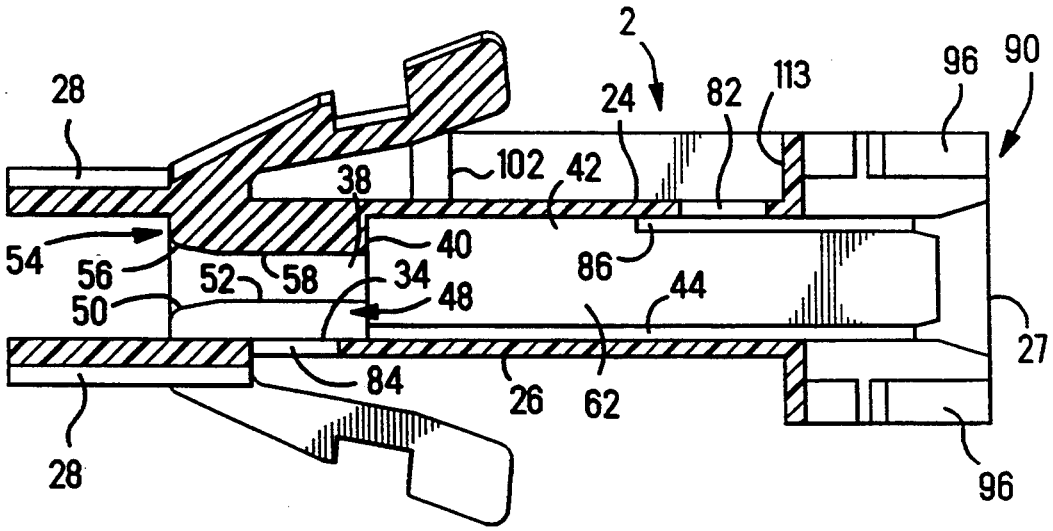
FIG. 8 is a view taken on the lines 8—8 of FIG. 7.
Figure 9:
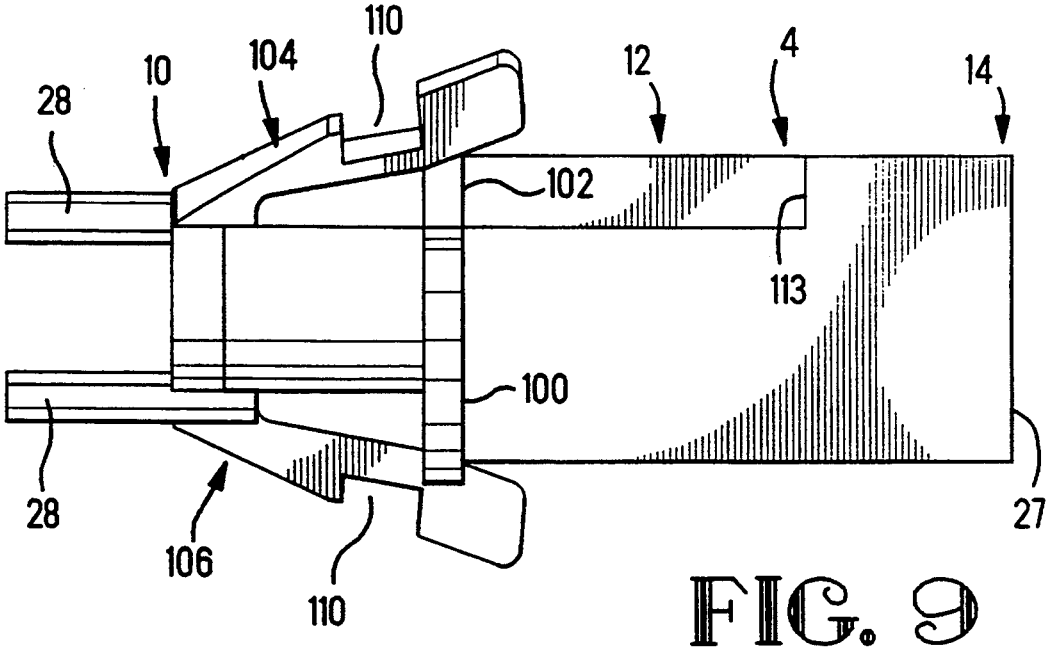
FIG. 9 is a view of the housing taken from one side.
Figure 11:
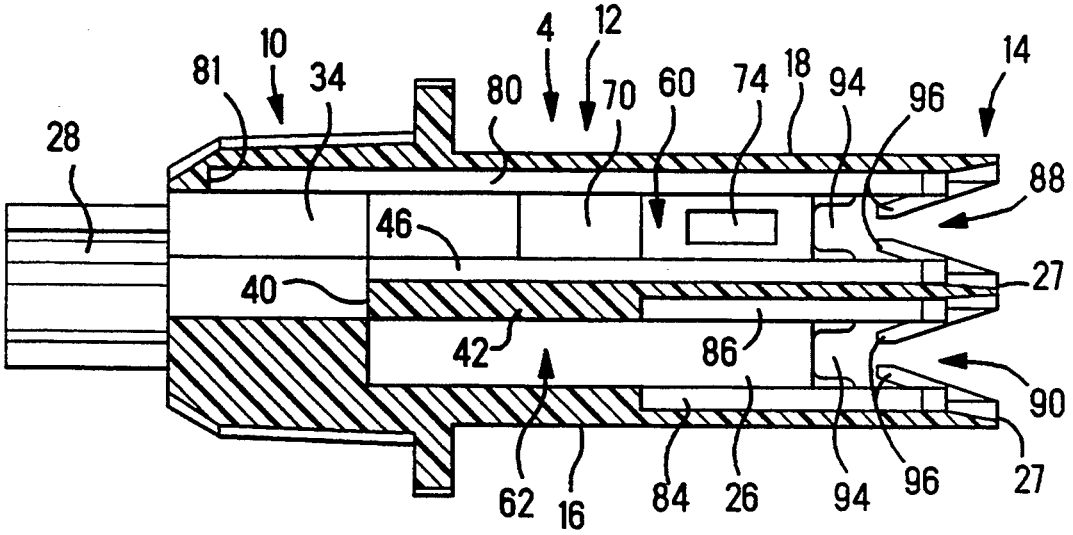
FIG. 11 is a view of the housing taken on the lines 11—11 of FIG. 10.
Figure 12:
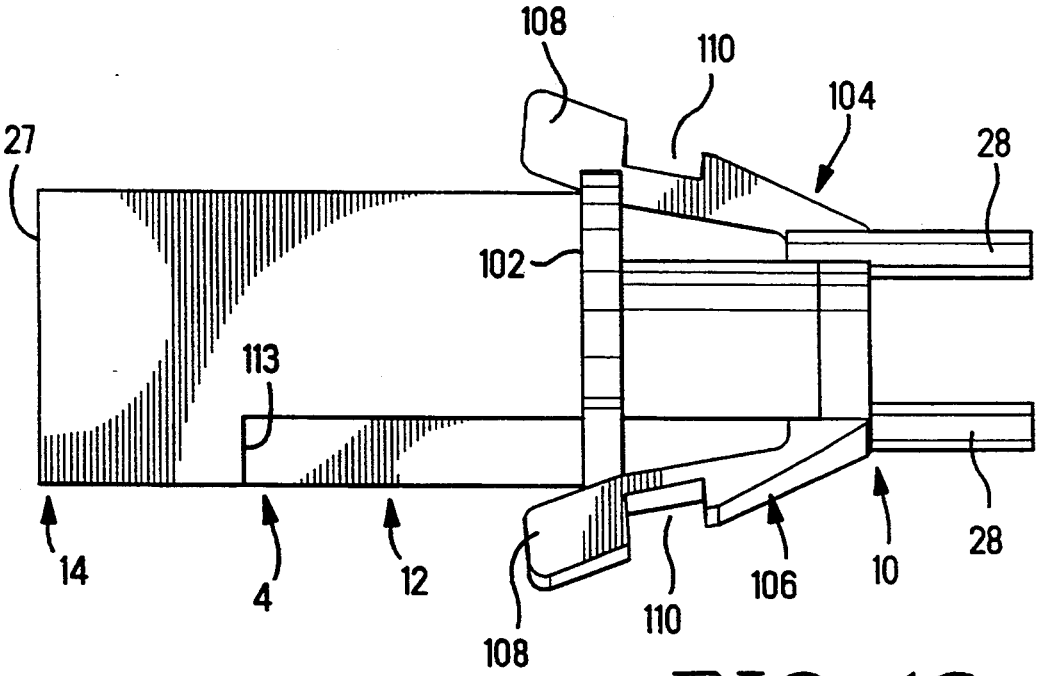
FIG. 12 is a side view of the housing taken from the opposite side thereof to that shown in FIG. 9.
Figure 14:
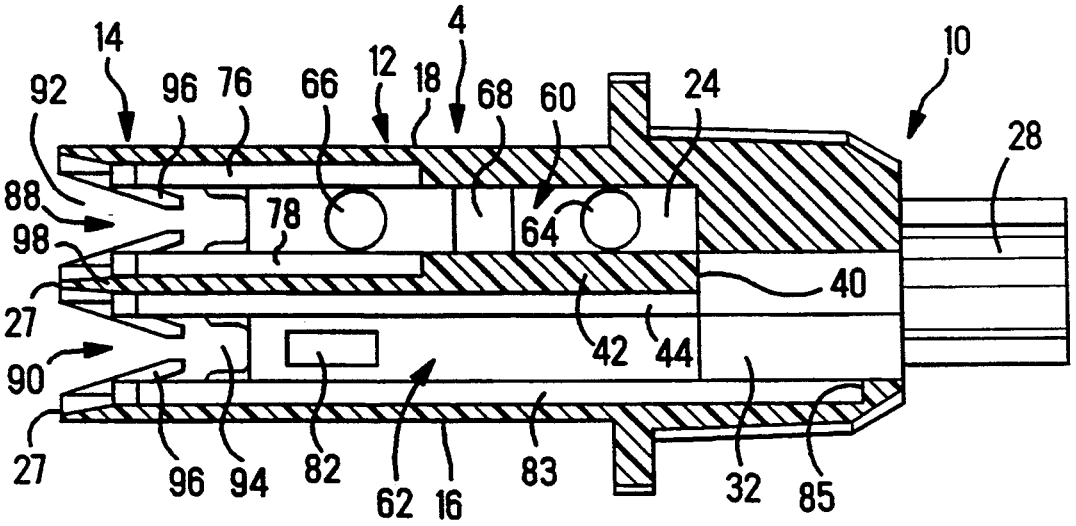
FIG. 14 is a view taken on the lines 14—14 of FIG. 13.
Figure 15:
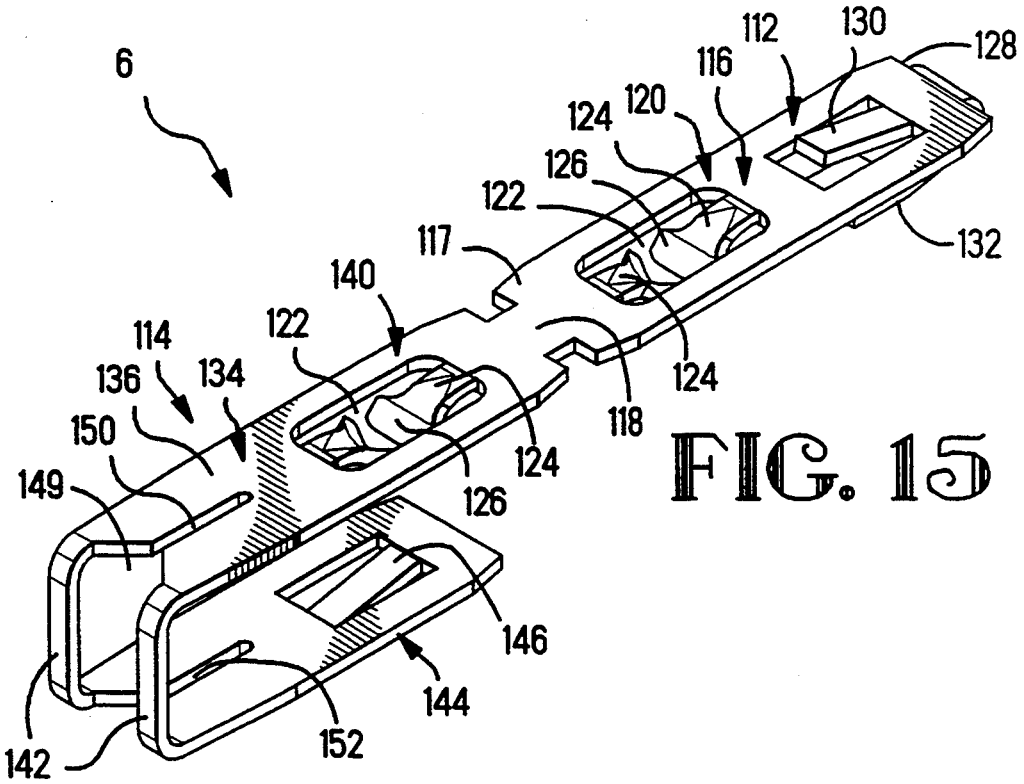
FIGS. 15 to 18 are an isometric view taken from above, an isometric view taken from below, a side view, and an underplan view, respectively, of a first electrical terminal of the connector.
Figure 16:
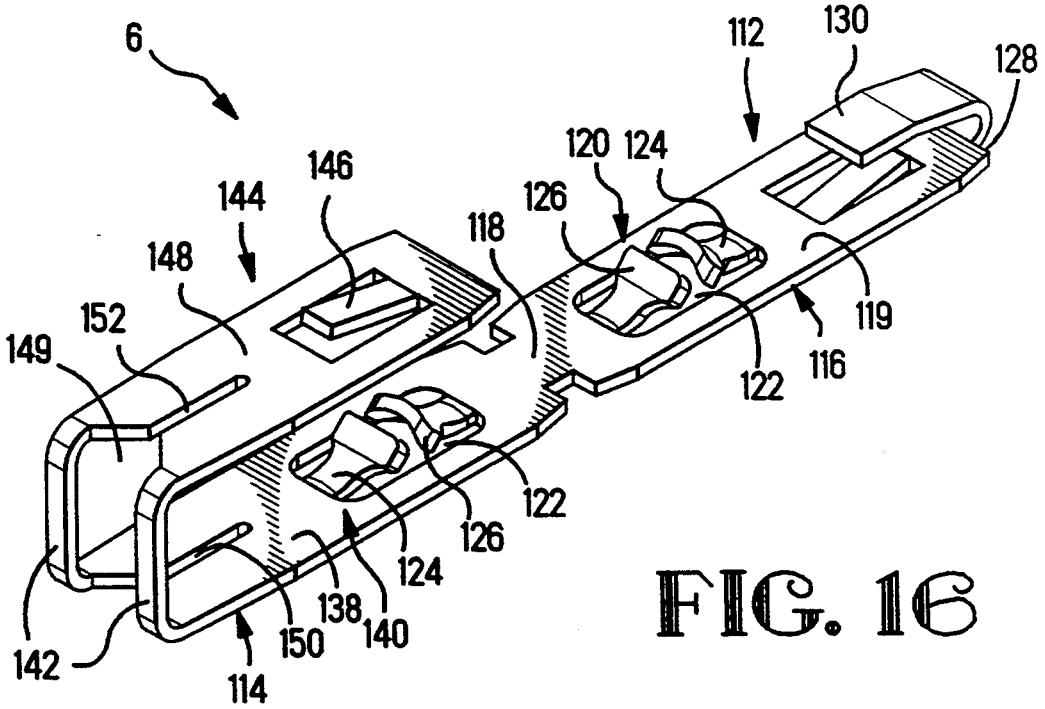
Figure 17:
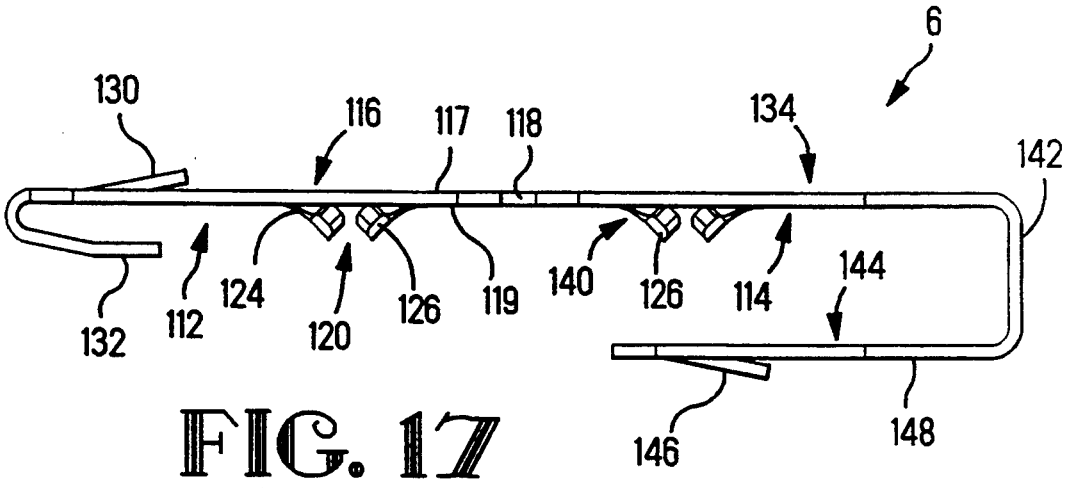

The top and bottom walls 24 and 26, the side wall portion 18, and the central wall 42 co-operate to define a first terminal receiving cavity 60, the top and bottom walls 24 and 26, the side wall portion 16 and the central wall 42, co-operating to define a second terminal receiving cavity 62. Each cavity 60 and 62 extends longitudinally of the housing 4 and opens at its forward end into the interior of the socket 10 and at its rear end into the terminal receiving face 27 of the housing 4. As best seen in FIGS. 5, 6 and 14, the top wall 24 defines two diode lead wire guiding circular through holes 64 and 66, respectively, which communicate with the interior of the cavity 60 and are arranged in spaced, aligned relationship longitudinally the housing 4. Between the holes 64 and 66 and being longitudinally aligned therewith, is a rectangular, tooling access, first through opening 68 in the top wall 24. A second and larger rectangular tooling access through opening 70 is formed in the bottom wall 26 opposite to the opening 68. An upper, terminal latching, forward opening 72 is formed in the top wall 24, a lower terminal latching rear opening 74 being formed in the bottom wall 26. The internal surfaces of the wall portion 18 and the wall 42, define in the cavity 60, laterally, and rearwardly opening lower terminal guide grooves 76 and 78, respectively, as best seen in FIG. 14. As best seen in FIG. 11, the internal surface of the wall portion 18 defines an upper, terminal guide groove 80 opposite to the groove 46 terminating forwardly of the housing in a terminal stop face 81. The top wall 24 defines a terminal latching, rear, through opening 82 communicating with the cavity 62, the bottom wall 26 defining a terminal latching, forward, through opening 84 also communicating with the cavity 62. The internal surface of the wall portion 16 defines a lower, rearwardly opening terminal guide groove 83, opposite to the groove 44, terminating forwardly of the housing 4 in a terminal stop face 85. As best seen in FIG. 11, the wall portion 16 and the wall 42 define opposed, rearward, rearwardly opening, terminal guide grooves and 84 and 86 respectively, in the cavity 62.

The lead connecting part 14 of the housing 4 defines a pair of juxtaposed lead receptacles 88 and 90 for the leads L1 and L2, respectively. Each of these receptacles has upper and lower, rearwardly flared lead guiding mouths 92 each leading forwardly to a lead receiving through recess 94. A resilient lead retention lug 96 projects obliquely towards each recess 94 on each side of each mouth 92. The lugs 96 for the recess 94 of the receptacle 88 project from the side wall portion 18 and from a rearward extension 98 of the wall 42. The lugs 96 for the recesses 94 of the receptacle 90 project from the side wall portion 16 and said extension 98. The cavity 60 opens rearwardly between the upper and lower recesses 94 of the receptacle 88, the cavity 62 opening rearwardly between the upper and lower recesses 94 of the receptacle 90.

Figure 2:
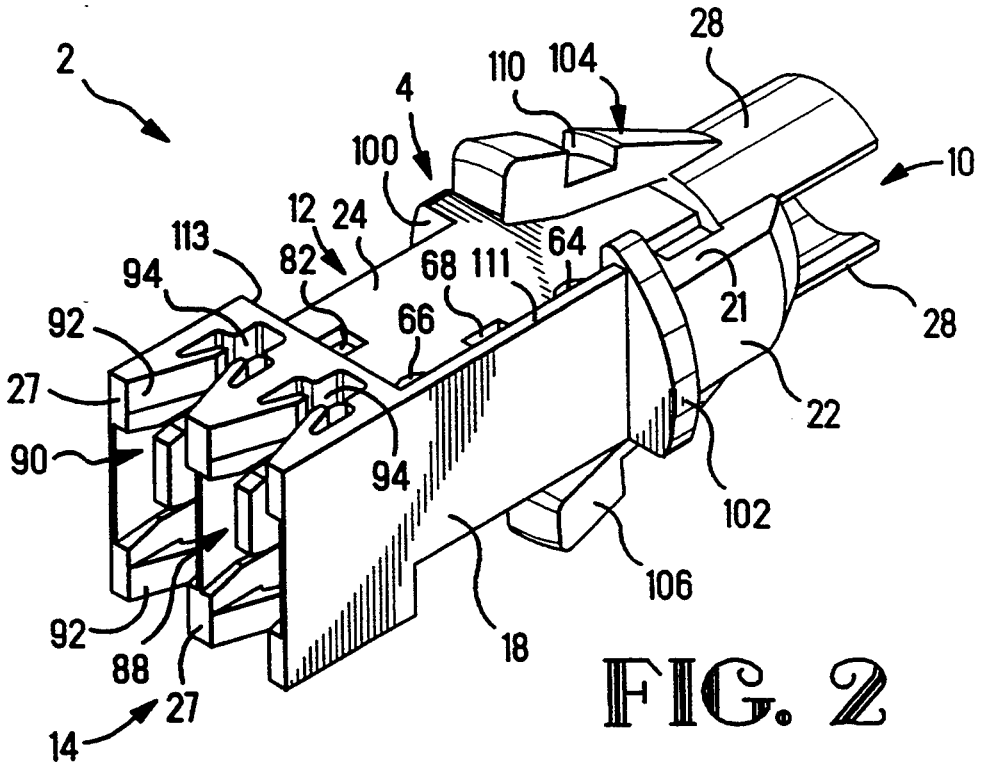
FIG. 2 is a similar view to that of FIG. 1 but having been taken from the rear.
Figure 3:
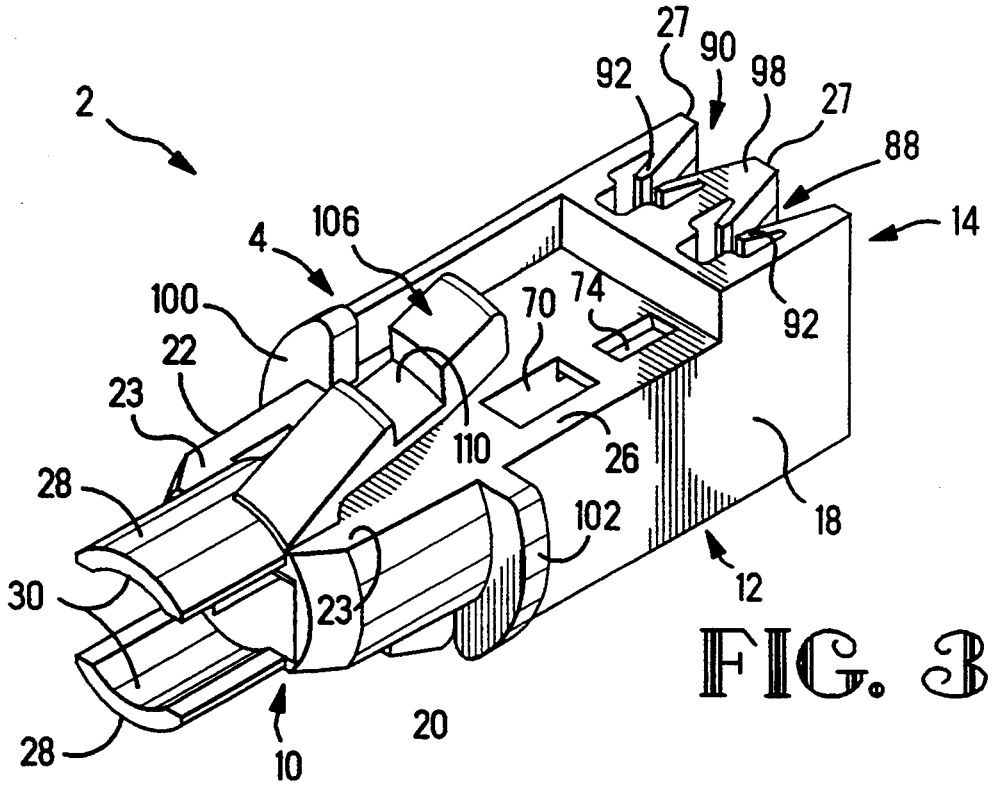
FIG. 3 is an isometric bottom view of the connector taken from the front.
Figure 4:
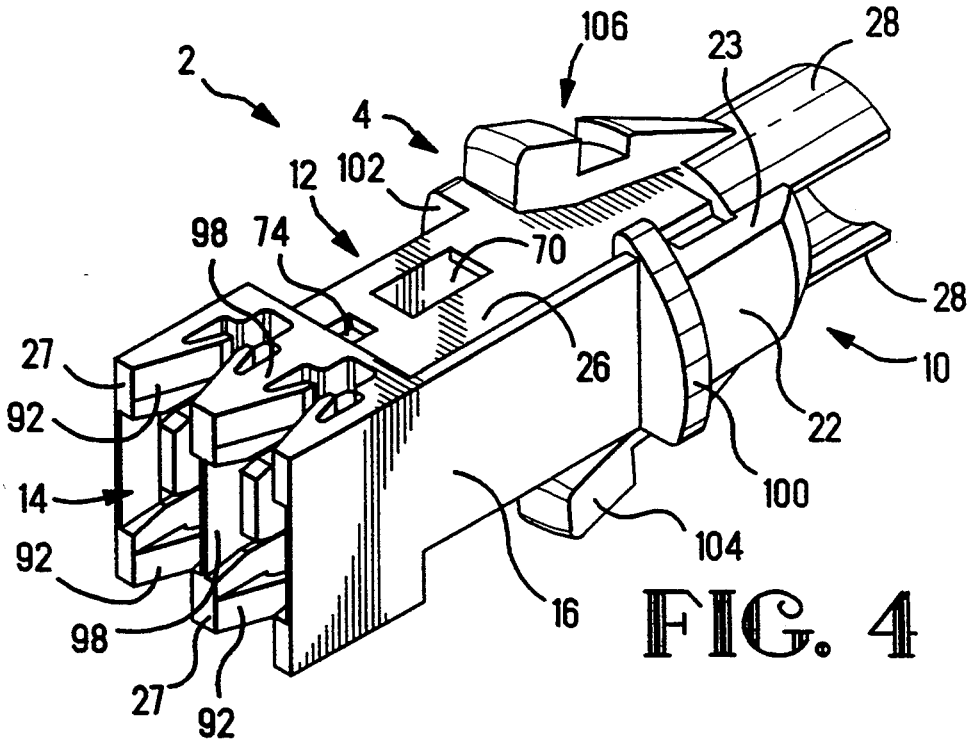
FIG. 4 is a similar view to that of FIG. 3 but having been taken from the rear.

Between the bulb socket 10 and the intermediate part 12 of the housing 4, there project outwardly thereof, opposed, outwardly bowed coplanar panel engaging cheeks 100 and 102, respectively. The project rearwardly, from the rear external surface of the bulb socket 10, upper and lower resilient cantilever, panel latch arms 104 and 106, respectively, which are offset from each other. Each arm 104 and 106, has its free end, a handle 108, and intermediate its end, a panel edge receiving arcuate notch 110. The side wall portion 18 has a part 111 upstanding from the upper wall 24 extending between the cheek 102 and a step 113 defined by the lead connecting part 14 to provide an emplacement for the diode D when it has been assembled to the connector 2 as will be described below, and also to provide protection for the latch arm 104 when it has been depressed towards the wall 24 when the connector 2 has been secured in an opening in a panel. This emplacement is best seen in FIGS. 1 and 2. As shown in FIGS. 3 and 4, a similar emplacement is provided on the lower side of the connector 2.

Figure 18:
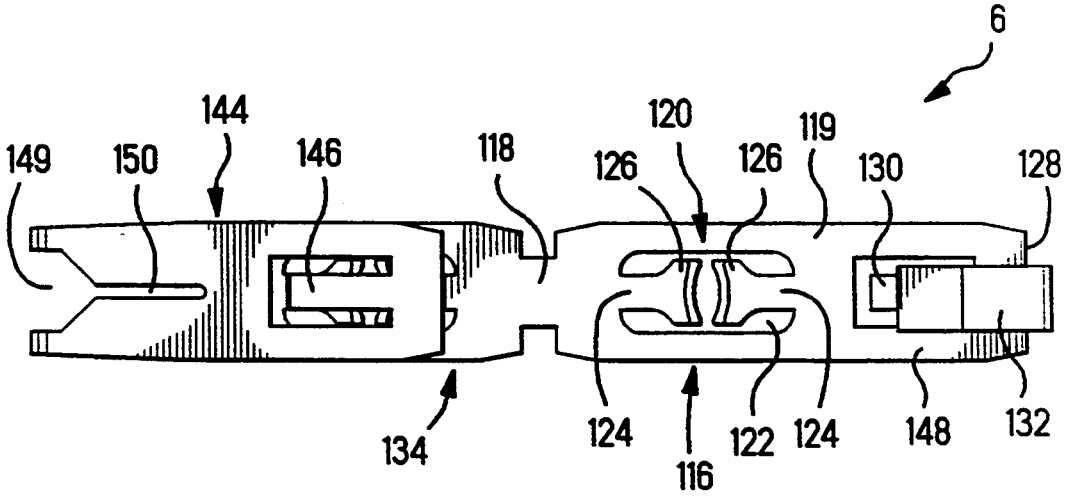
Figure 19:
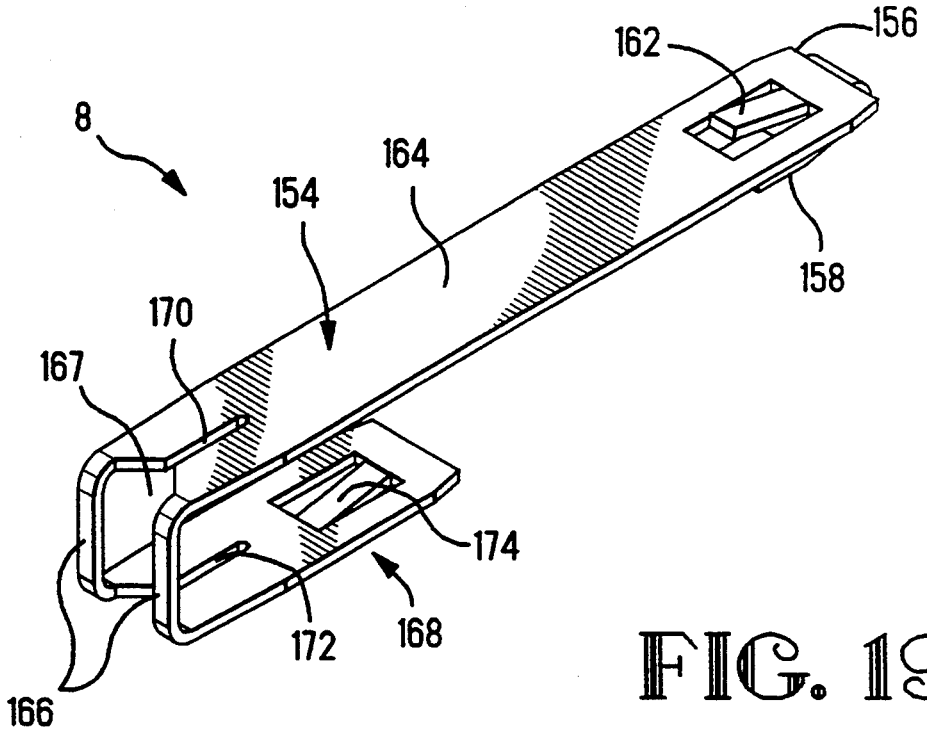
FIGS. 19 to 22 are an isometric view taken from below, an isometric view taken from above, a top plan view, and a side view, respectively, of a second electrical terminal of the connector.
Figure 20:
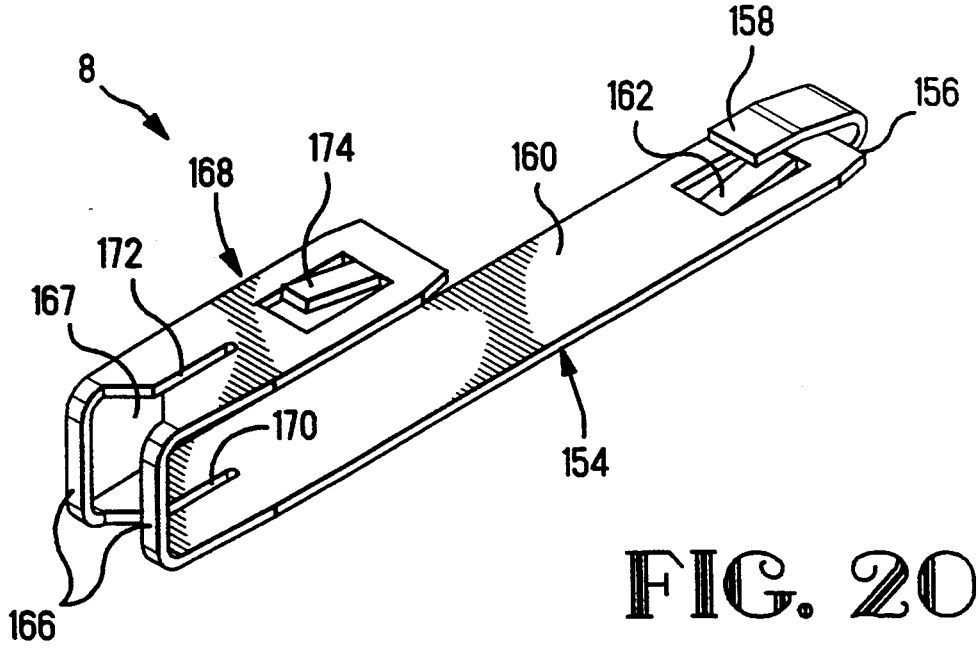

As best seen in FIGS. 15 to 18 each first terminal 6, which has been stamped and formed from a single piece of sheet metal stock, comprises a forward, diode lead wire receiving portion 112 and a rear, diode lead receiving portion 114. The portion 112 comprises a flat, elongate plate 116 having an upper face 117 and a lower face 119. The rear end of the plate 116 is connected to the portion 114 of the terminal 6, by way of a metal slug 118 which can be sheared out. The plate 116, has, intermediate its ends, a diode lead wire receiving spring lock socket 120 comprising an elongate through opening 122 from each of the two opposite ends of which depends a spring finger 124, the fingers 124 converging towards each other in a direction away from the lower face 119 of the plate 116. Each finger 124 has a laterally enlarged, arcuate, lead wire gripping head 126 at its free end. The heads 126 are concave in a direction towards each other. Between the forward end 128 of the plate 116 and spring socket 120, there is struck out from the plate 116 a latching tongue 130 projecting obliquely rearwardly from the upper face 117 of the plate 116. A cantilever contact spring 132 projects from the forward end 128 of the plate 116 and is reversely bent so as to overlie the lower face 119 of the plate 116. As best seen in FIG. 18, the contact spring 132 is offset towards one side of said forward end 128 to provide a forward edge for engaging the stop face 81 of the groove 80. The rear portion 114 of the terminal 6 comprises a first flat plate 134 having an upper face 136 and a lower face 138. The forward end of the plate 134 is connected to the slug 118. Rearwardly of the slug 118, the plate 134 is formed with a rear, diode lead wire receiving spring lock socket 140 which is identical with the spring lock socket 120 and the parts of which accordingly bear the same reference and numerals as the spring socket 120. The fingers 124 of the socket 120 depend from the face 138 of the plate 134. The plate 134 is connected by way of the spaced straps 142, to a further flat plate 144 extending parallel to the plate 134 and being shorter than the plate 134. There is struck out from the plate 144 proximate to its forward end, a latching tongue 146 projecting briefly rearwardly, below the lower face 148 of the plate 144. The straps 142 cooperate to define between them, rearwardly flared, lead receiving mouths 149 for the lead L1. The plate 134 is formed with a wire slot 150 for receiving the lead core, the plate 144 being formed with a similar wire slot 152 aligned with the slot 150, each of the slots 150 and 152 opening into a respective mouth 149.

As best seen in FIGS. 19 to 22, the terminal 8, which like the terminal 6, was stamped and formed from a single piece of sheet metal stock, comprises a first flat plate 154, from the forward end 156 of which projects a cantilever contact spring 158 reversely bent so as to overlie the upper face 160 of the plate 154 in spaced relationship thereto. Just rearwardly of the spring 158, a latching tongue 162 projects obliquely rearwardly from the lower face 164 of the plate 154. The rear end of the plate 154 is connected by spaced straps 166 to a further, but shorter, flat plate 168 parallel to, and aligned with the plate 154. The straps 166 define rearwardly flared lead receiving mouths 167 for the lead L2.

Figure 21:
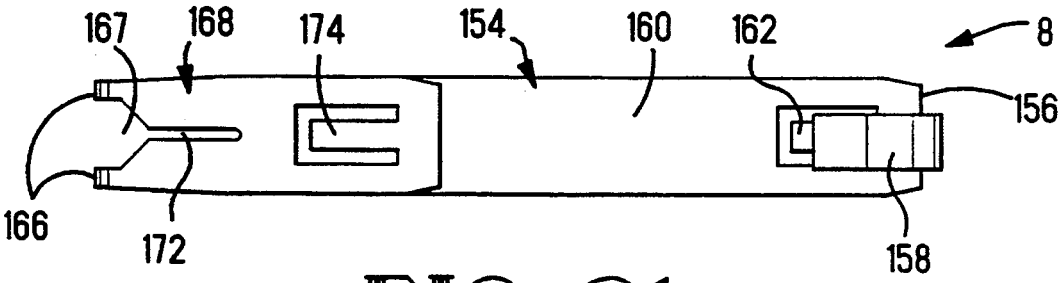
Figure 22:
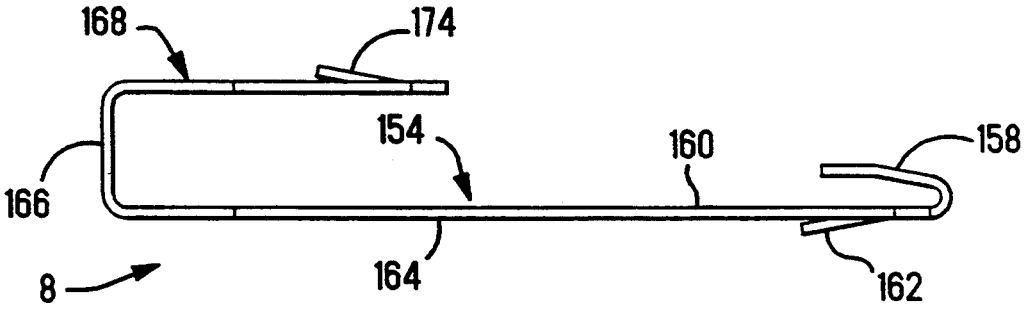

Lead receiving mouths 167 for the lead L2 wire slots 170 and 172 analogous to the slots 150 and 152, in the plates 154 and 168, respectively, open into respective mouths 167. A latching tongue 174 struck out from the plate 168 projects obliquely rearwardly in a direction away from the plate 154. As best seen in FIG. 21, the contact spring 158 is offset to one side of the forward end 156 of the plate 154 to provide a forward edge for engaging the stop face 85 of the groove 83.

Figure 23:
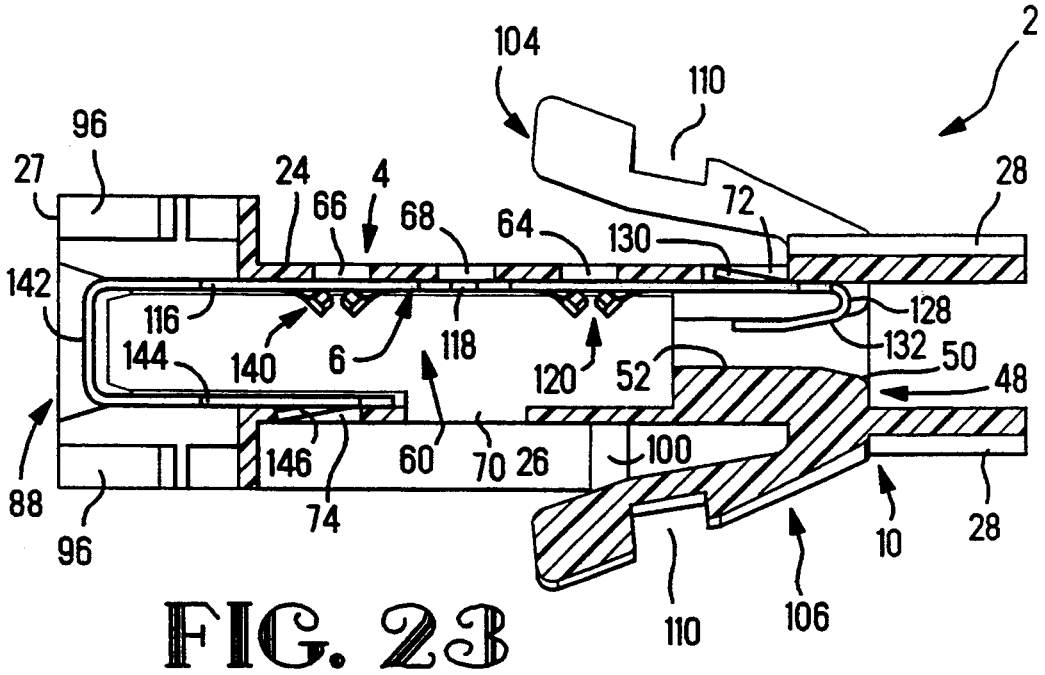
FIG. 23 is a similar view to that of FIG. 6 but showing the first terminal assembled to the housing.
Figure 24:
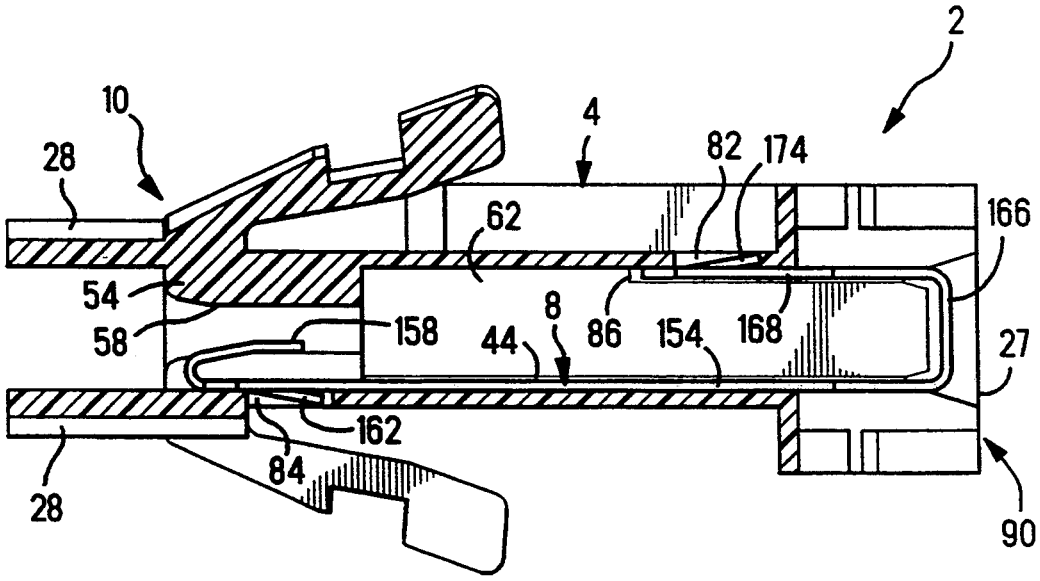
FIG. 24 is a similar view to that of FIG. 8 but showing the second electrical terminal assembled to the housing.

The assembly of the terminal 6 to the housing 4 will now be described with reference to FIG. 23. The terminal 6 is inserted into its cavity 60 by way of the terminal receiving face 27 of the housing 4, with the forward end 128 of the plate 116 leading, so that the tongues 130 and 146 latch into the respective openings 72 and 74 in the housing 4, the lateral edges of the plate 116 being slidably received in respective ones of the grooves 46 and 80, and the lateral edges of the plate 144 being slidably received in respective ones of the grooves 76 and 78. The straps 142 are received in the lead receptacle 88 with the wire slots 150 and 152 extending rearwardly into the recesses 94 of the receptacle 88. With the terminal 6 so located in the housing 4, the spring sockets 120 and 140 are aligned with the holes 64 and 66, respectively, in the wall 24, the slug 118 being aligned with both of the access openings 68 and 70 and the contact spring 132 lying opposite to the support surface 52 of the support rib 48, the end 128 abutting the stop face 81. The terminal 8 is inserted into the cavity 62 by way of the terminal receiving face 27, with the forward end 56 of the plate 154 leading, until, as shown in FIG. 24, the tongues 162 and 174 snap into the respective openings 82 and 84 in the housing 4, the lateral edges of the plate 154 being slidably received in respective ones of the grooves 44 and 83 and the lateral edges of the plate 168 being slidably received in respective ones of the grooves 84 and 86, the end 156 abutting the stop face 85. With the terminal so assembled to the housing 4, the contact spring 158 lies opposite to the support surface 58 of the support rib 54, the straps 116 being disposed in the receptacle 90, with the wire slots 170 and 172 extending rearwardly into the recesses 94 of the receptacle 90.

With the terminals 6 and 8 assembled to the housing 4 as described above, the connector 2 is ready for use if no diode is to be connected in circuit with the bulb B. In this case, the leads L1 and L2 can be operatively inserted into the receptacles 88 and 90 as described below, and a bulb can be inserted into the socket 10 also as described below. The bulb in thus directly connected to its leads L1 and L2 by way of the one piece terminals 6 and 8.

Where the diode D is to be connected in circuit with the bulb B, the slug 118 connecting the two parts 112 and 114 of the terminal 6 is sheared out by means of tooling (not shown) inserted through the tooling access openings 68 and 70 in the housing 4, whereby the parts 112 and 114 are electrically isolated from each other as shown in FIG. 25. Lead wires LW1 and LW2, which extend, in the same direction, at right angles to the body of the diode D, are then inserted through respective ones of the holes 64 and 66 in the housing wall 24 and thence through the respective spring lock sockets 120 and 140, aligned therewith. During such insertion of the lead wires LW1 and LW2, the spring fingers 124 of each spring socket are resiliently forced apart from each other by the respective lead wires, so that each lead wire LW1 and LW2 is firmly gripped between the concave surfaces of the heads 126 of a respective pair of the fingers 124. The parts 112 and 114 of the terminal 6 are accordingly bridged by the diode D. With the diode D so assembled to the connector 2, the supply leads L1 and L2 are forced, by means of suitable tooling (not shown) into the receptacles 88 and 90 respectively, so that, guided by the mouths 149 and 167 of the terminals 6 and 8, respectively, the lead L1 is forced into the wire slots 150 and 152 of the terminal 6, the lead L2 being forced into the wire slots 170 and 172 of the terminal 8, whereby the edges of each wire slot sever the insulation of the respective lead to make firm and permanent electrical contact with the metal core of the lead.

Figure 28:
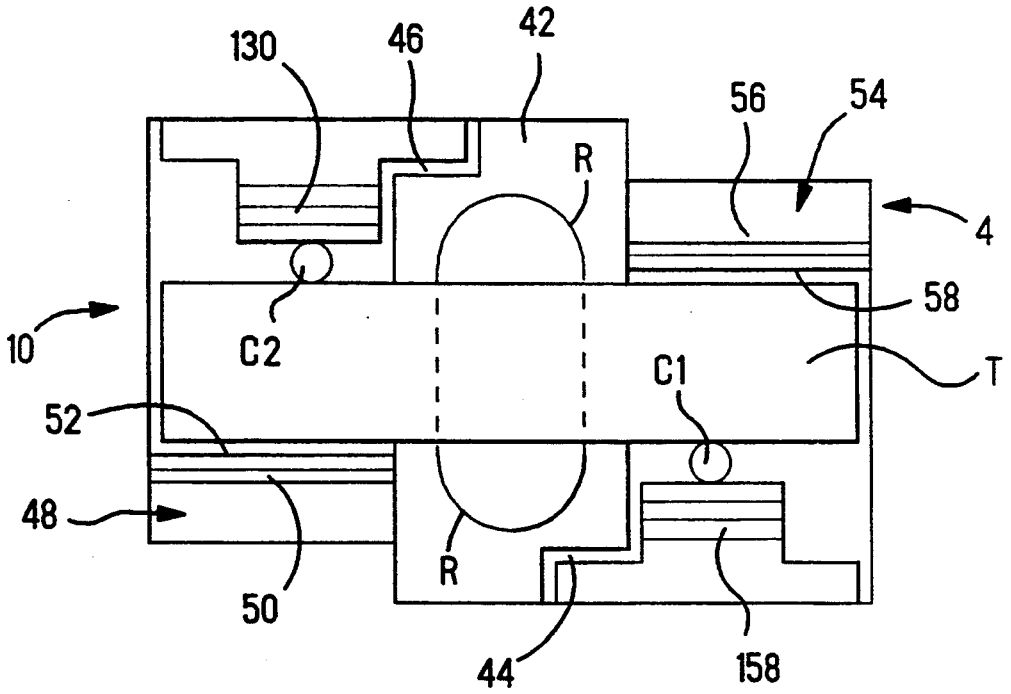
FIG. 28 is a schematic front view illustrating how a contact carrying tail of the lamp bulb is received in the bulb socket.

In order to assemble the bulb B, to the connector 2, the tail T of the bulb B is inserted into the socket 10 in the direction of the arrow A in FIG. 25, to an extent limited by the abutment of the rear end of the tail T with the abutment surface 40 of the wall 42 whereby, as shown schematically in FIG. 28, one of the contacts C1 and C2, on one side of the rib R engages the contact spring 130 with the terminal 6, the other of the contacts C1 and C2, on the opposite side of the rib R engaging the contact spring 158 of the terminal 8. In the inserted position of the bulb B, the envelope L thereof is resiliently gripped between the guides 28, the tail T on one side of the rib R being resiliently gripped between the contact spring 130 and the surface 52 of the rib 48 and the tail T on the other side of the rib R being resiliently gripped between the contact spring 158 and the surface 58 of the rib 54, as will be apparent from FIG. 28. The guiding surfaces 50 and 58 of the ribs 48 and 54 assist in guiding the tail T into its inserted position. The bulb B is accordingly firmly, but removeably retained in the socket 10. It will be apparent from FIG. 28, that the tail T can be operatively inserted into the socket 10 in either of two opposite angular orientations, but in no other angular orientation. The bulb B is inserted into the socket 10 in a straight line without the need for subsequent angular manipulation of the bulb B.

Figure 13:
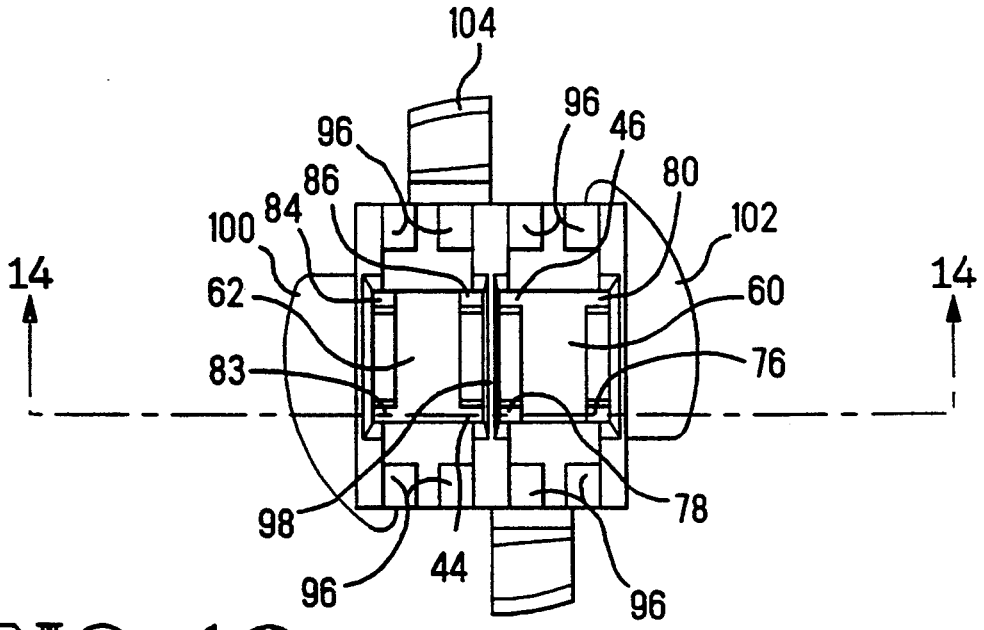
FIG. 13 is a rear view of the housing.
Figure 29:
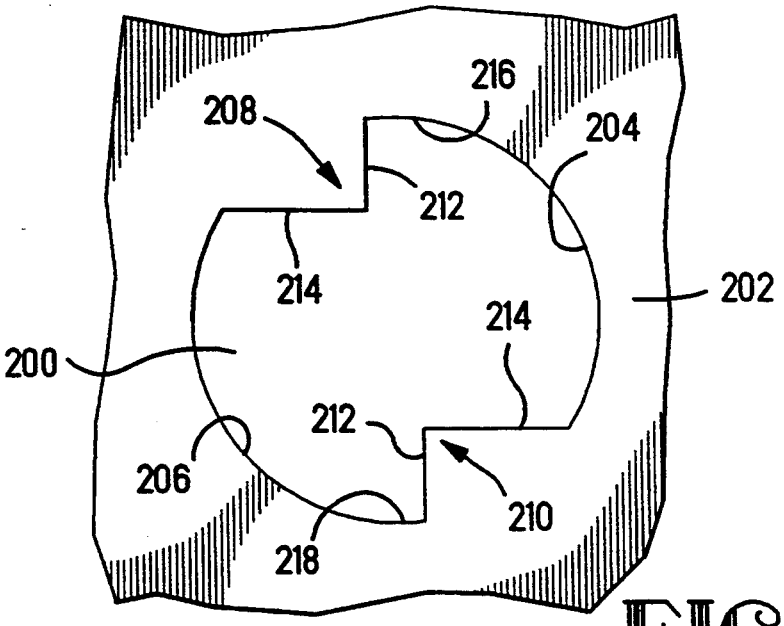
FIG. 29 is a fragmentary rear view of a panel in a hole in which the connector is to be mounted.

The connector 2 with the bulb B and leads L1 and L2 assembled thereto can be mounted in a hole 200 in a panel 202 (FIG. 29). The hole 200 has opposite, arcuate, upper and lower peripheral edge portions 204 and 206, connected by right angle edge portions 208 and 210, respectively, each having a vertical part 212 and a horizontal part 214. In order to mount the connector 2 in the hole 200, the operator depresses the latch arms 104 and 106 resiliently towards each other by means of the handles 108, with the rear faces of the latch arms extending vertically as shown in FIG. 13, and inserts the connector 2 into the hole 200 with the socket 10 leading, until the cheeks 100 and 102 bottom against the back face of the panel 202. In the inserted position of connector 2, the flat top 21 of the wall portion 22 and the adjacent part of the wall 24 are engaged by the edge part 214 of the hole 200, the flat bottom 23 of the wall portion 20 and the adjacent part of the wall 26 being engaged by the edge part 212 of the hole 200, whereby the connector is non-rotatable with respect to the panel 202. The edge parts 212 are engaged by respective sides of the arms 104 and 106. The operator then releases the latch arms so that the arcuate notch of the arm 104 receives an arcuate edge part 216 of the hole 200, adjacent to the edge part 212 of the edge portion 208, the notch 110 of the arm 106 receiving an edge part 218 of the hole 200, adjacent to the edge part 212 of the edge portion 210. The peripheral arcuate edge portions 204 and 206 embrace the arcuate faces of the wall portions 20 and 22, respectively. The connector 2 could be inserted into the hole 200 in the opposite angular orientation to that described above but in no other angular orientation.

I claim:

1. An electrical connector comprising an insulating housing defining a socket for an electric lamp bulb, and first and second cavities receiving first and second terminals respectively, in electrical isolation from each other, each terminal having a contact spring in the socket for engaging a respective contact of the bulb and a lead connecting portion which is accessible externally of the housing for connection to an electrical supply lead, an external wall of the housing being formed with first and second supply lead wire guiding holes therein, the first terminal being formed with first and second supply lead wire receiving spring sockets each aligned with a respective one of said first and second supply lead wire guiding holes, for the retention therein of a supply lead wire inserted through said respective supply lead wire guiding hole, the first terminal having, intermediate said spring sockets, a portion which is accessible externally of the housing and is severable to divide the second terminal into two electrically isolated parts.

2. A connector as claimed in claim 1, wherein the contact springs of the first and second terminals are arranged in the socket in superposed, but laterally spaced, relationship with each other, a raised support for a flat contact bearing end portion of the lamp bulb being provided in the socket beside each contact spring, the raised supports and the contact springs being so positioned relative to one another, that each contact spring urges said contact bearing end portion against the raised support beside the other contact spring, when said contact bearing end portion has been inserted into the socket.

3. A connector as claimed in claim 2, wherein the socket has an internal top wall, an internal bottom wall, and opposed internal side walls, one of the contact springs projecting from the top wall of the socket proximate to one of the side walls, the other contact spring projecting from the bottom wall of the socket proximate to the other side wall, one of the raised supports being proximate to the top wall and said other side wall and the other raised support being proximate to the bottom wall and said other side wall.

4. A connector as claimed in claim 1, wherein there project from the socket, a pair of opposed lamp bulb guides having arcuate facing surfaces for resiliently gripping the lamp bulb between them.

5. A connector as claimed claim 1, wherein said first and second cavities extend through the housing in parallel relationship with each other, an internal wall of the housing extending between said cavities having an abutment end in the socket, providing a stop for limiting insertion of the lamp bulb into the socket.

6. A connector as claim in claim 5, wherein said internal wall of the housing is formed on one side thereof with a first groove proximate to said external wall of the housing for slideably receiving a lateral edge of the first terminal and with a second groove proximate to the opposite external wall of the housing for receiving a lateral edge of the second terminal, each cavity opening into a terminal receiving face of the housing opposite to the bulb socket.

7. A connector as claimed in claim 6, wherein a first side wall of the housing on one side of said internal wall of the housing has a groove opposite to said first groove for receiving a further lateral edge of the first terminal, a second side wall of the housing on the opposite side of said internal wall to said first side wall, having a groove for slideably receiving a further lateral edge of the second terminal, the groove in said first side wall being opposite to the first groove in said internal wall and the groove in said second side wall being opposite to the second groove in said internal wall.

8. A connector as claimed in claim 1, wherein the housing is elongate and the lead wire guiding holes are spaced from each other, and are aligned with each other, longitudinally of the housing.

9. A connector according to claim 1, wherein said external wall of the housing is formed with a first tooling access opening in alignment with the severable portion of the first terminal, an opposite external wall of the housing being formed with a second tooling access opening opposite to the first tooling access opening.

10. A connector as claimed claim 1, wherein the first terminal comprises a flat plate connecting the contact spring of the first terminal to the lead connecting portion thereof, each lead wire receiving spring socket of the first terminal comprising a pair or spring fingers projecting from opposite edges of an opening in said plate and converging towards each other in a direction away from said external wall of the housing, each spring finger having a head remote from said plate, said heads presenting concave, lead wire gripping surfaces facing each other.

11. The connector of claim 1, wherein said first terminal comprises a flat elongate plate having a first end and a second end, said contact spring projecting from the first end and being reversely bent so as to overlie one side of the plate in spaced relationship thereto, the other end of the plate being slotted to receive the electrical supply leads, electrically to connect the core of the lead to the terminal, the first and second supply lead wire receiving spring sockets being spaced from each other longitudinally of the plate, between the first and second ends thereof, each spring socket comprising a plurality of spring fingers projecting from an edge of an opening in the plate from the side thereof which is overlaid by the contact spring and converging towards one another in a direction away from the plate, the plate being formed with a severable portion of reduced cross-section between said spring sockets.

12. A terminal as claimed in claim 11, wherein each spring finger has a transverse head remote from the plate, the heads having concave surfaces for cooperation in gripping a lead wire between them.

13. An electrical connector for use in connecting first and second electrical conductors, optionally with a circuit component interposed therebetween, the connector comprising an insulating housing defining a terminal receiving cavity opening into opposite ends of the housing, and first and second aligned, through, tooling access openings intermediate said ends of the housing and being provided in respective first and second opposite external walls thereof, a one piece electrical terminal secured in the cavity having a first conductor connecting portion exposed for connection to the first conductor through one end of the cavity, a second conductor connecting portion exposed through the other end of the cavity, for receiving the second conductor and a severable, reduced cross section portion aligned with both of said openings and being located therebetween, one of said first and second opposite walls, having a component lead wire guiding through hole on either side of said reduced cross section severable portion, the terminal being formed with first and second lead wire receiving spring sockets each aligned with a respective one of said holes, for the retention therein of a lead wire inserted through said respective hole, the reduced cross-section portion of the terminal being severable by means of tooling inserted through said tooling access openings, to divide the terminal into two electrically isolated parts.

14. An electrical connector as claimed in claim 1 or 13, for insertion in a hole in a mounting panel, wherein the housing comprises first and second, opposed, panel face engaging cheeks projecting laterally from the housing in coplanar relationship, and a pair of resilient latch arms each extending obliquely outwardly from a panel insertion forward end portion of the housing and between said cheeks, the latch arms being offset from each other on opposite sides of the housing, each latch arm having a panel edge receiving notch opening away from the housing and being positioned lengthwise of the latch arm to receive an edge of the panel when the cheeks are engaged with a face of the panel, the housing having a flat face located beneath each latch arm and extending forwardly of, and normally of, said cheeks.

* * * * *